US010617932B2

(12) United States Patent
Ferraro

(10) Patent No.: US 10,617,932 B2
(45) Date of Patent: Apr. 14, 2020

(54) PINE TAR APPLICATOR FOR BASEBALL BATS AND METHOD OF USE

(71) Applicant: Michael Ferraro, Scottsdale, AZ (US)

(72) Inventor: Michael Ferraro, Scottsdale, AZ (US)

( * ) Notice: Subject to any disclaimer, the term of this patent is extended or adjusted under 35 U.S.C. 154(b) by 0 days.

(21) Appl. No.: 15/372,711

(22) Filed: Dec. 8, 2016

(65) Prior Publication Data

US 2017/0182395 A1 Jun. 29, 2017

Related U.S. Application Data

(60) Provisional application No. 62/268,548, filed on Dec. 17, 2015.

(51) Int. Cl.
*A63B 71/00* (2006.01)

(52) U.S. Cl.
CPC ..... *A63B 71/00* (2013.01)

(58) Field of Classification Search
CPC ..... A63B 71/00; A45D 40/0087
USPC ..... 428/40.3, 41.8; 473/451, 453, 568
See application file for complete search history.

(56) References Cited

U.S. PATENT DOCUMENTS 2,492,689 A * 12/1949 Danovitch ..... H01B 3/50 442/117
2,984,486 A 2/1959 Jones
4,015,851 A 4/1977 Pennell
4,909,650 A 3/1990 Gilbert
5,192,386 A * 3/1993 Moir ..... A45D 40/0087 156/249
5,318,371 A 6/1994 Niewulis
5,492,425 A 2/1996 Carter et al.
5,611,533 A 3/1997 Williams
5,747,738 A * 5/1998 Indoe ..... B44C 7/08 156/289
5,772,524 A * 6/1998 Huang ..... A63B 49/08 473/300
5,867,868 A 2/1999 Ward
6,685,372 B1 2/2004 Foss et al.
8,501,640 B2 * 8/2013 Suzuki ..... C09J 7/045 428/343

(Continued)

FOREIGN PATENT DOCUMENTS

GB 948765 A * 2/1964 ..... B29C 70/10

OTHER PUBLICATIONS

Brian Clark, "How to Replace Baseball Bat Handle Cover", Apr. 19, 2010, http://www.mademan.com/mm/how-replace-baseball-bat-handle-cover.html.*

(Continued)

*Primary Examiner* — Laura Davison
(74) *Attorney, Agent, or Firm* — Parsons & Goltry; Robert Parsons; Michael Goltry

(57) ABSTRACT

A pine tar applicator for use on baseball bats, includes a base sheet having a first side and a second side, a pine tar layer coating at least a portion of the first side of the base sheet, a cover sheet overlying and covering the pine tar layer, an adhesive layer overlying at least a portion of the second side of the base sheet, and a protective sheet overlying and covering the adhesive layer. In use, the protective sheet is removed and the base sheet is wrapped about the baseball bat with the adhesive contacting the bat. The cover sheet is then removed exposing the pine tar layer.

12 Claims, 1 Drawing Sheet

(56) References Cited

U.S. PATENT DOCUMENTS

| | | | | |
|---|---|---|---|---|
| 2014/0190623 | A1* | 7/2014 | Bradford | C09J 7/0264 156/185 |
| 2014/0371008 | A1* | 12/2014 | Geotsalitis | A63B 69/0002 473/457 |
| 2015/0080145 | A1* | 3/2015 | Roller | B29C 63/42 473/282 |

OTHER PUBLICATIONS

Softball Fans Forum, "pine tar or spray adhesive??", http://forums.softballfans.com/threads/pine-tar-or-adhesive-spray.894897/, Aug. 19, 2010.*

Pelican Bat Wax, "Step-by-Step Guide on How to Apply the Stick, Pine Stick & Grip Dip", https://www.pelicanbatwax.com/blogs/news/33577028-step-by-step-guide-on-how-to-appl, published Jun. 17, 2015 (Year: 2015).*

* cited by examiner

PINE TAR APPLICATOR FOR BASEBALL BATS AND METHOD OF USE

CROSS-REFERENCE TO RELATED APPLICATION

This application is a Non-Provisional Utility Application of currently U.S. Provisional Application Ser. No. 62/268,548, filed 17 Dec. 2015.

FIELD OF THE INVENTION

This invention relates to baseball accessories.

More particularly, the present invention relates to the application and use of pine tar and faux pine tar materials.

BACKGROUND OF THE INVENTION

In baseball, pine tar is applied to the handles of baseball bats. Because of its texture, pine tar improves a batter's grip on the bat and prevents the bat from slipping out of the batter's hands during hard swings. Major League Baseball still requires players to use wooden bats. Since they can be quite slippery, league rules allow players to add up to 18 inches of pine tar to aid in grip. The better the grip on the bat, the more loosely a player can grip it, allowing for more "pop" and less stinging when contact is made with the ball.

Conventionally, pine tar has been applied to the handle of a bat by use of a pine tar stick or a pine tar rag. In both instances, pine tar is applied to the handle of the bat in the desired location. Often, pine tar is applied to the handle of the bat at the throat, between the grip and the barrel. In this manner, the player can reach down the bat and obtain as much or as little pine tar as desired before returning the hands to the grip area of the handle.

While this method has proved effective, there are drawbacks. Specifically, a build-up of pine tar can occur on the handle of the bat. Additionally, the pine tar on the bat can prove to be messy when the bat is stored after use. Removal of pine tar is very difficult, generally requiring a solvent and much scrubbing.

It would be highly advantageous, therefore, to remedy the foregoing and other deficiencies inherent in the prior art.

An object of the present invention is to provide a pine tar applicator which is easily coupled to a baseball bat.

Another object of the present invention is to provide a pine tar applicator which allows for quick and easy removal of pine tar from a baseball bat.

SUMMARY OF THE INVENTION

Briefly, to achieve the desired objects and advantages of the instant invention, a pine tar applicator for use on baseball bats is provided. The pine tar applicator includes a base sheet having a first side and a second side, a pine tar layer coating at least a portion of the first side of the base sheet, a cover sheet overlying and covering the pine tar layer, an adhesive layer overlying at least a portion of the second side of the base sheet, and a protective sheet overlying and covering the adhesive layer.

In a specific aspect the adhesive layer includes a contact adhesive having an adhesive strength sufficient to securely affix the base sheet to a bat under normal use, while having a release point allowing separation of the base sheet from the bat under greater loads resulting from peeling the sheet from the bat. The base sheet includes opposing longitudinal edges positionable longitudinally along a length of a bat, and opposing transverse edges positionable transverse to a longitudinal axis of the bat. A perforated strip extends between opposing transverse edges. The adhesive layer is omitted from the perforated strip to facilitate removal when the strip is removed along the perforation.

Also provided is a method of using a pine tar applicator with a baseball bat. The method includes the steps of providing a baseball bat including a knob at one end from which extends a handle having a grip portion and a throat portion, a barrel extends from the handle and terminates in an end. Also provided is a pine tar applicator including a base sheet having a first side and a second side, a pine tar layer coating at least a portion of the first side of the base sheet, a cover sheet overlying and covering the pine tar layer, an adhesive layer overlying at least a portion of the second side of the base sheet, and a protective sheet overlying and covering the adhesive layer. The method includes removing the protective sheet from the adhesive layer, wrapping the base sheet around the handle of the baseball bat at the throat with the adhesive contacting the bat, and removing the cover sheet to expose the pine tar layer.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENTS

Figure 1:
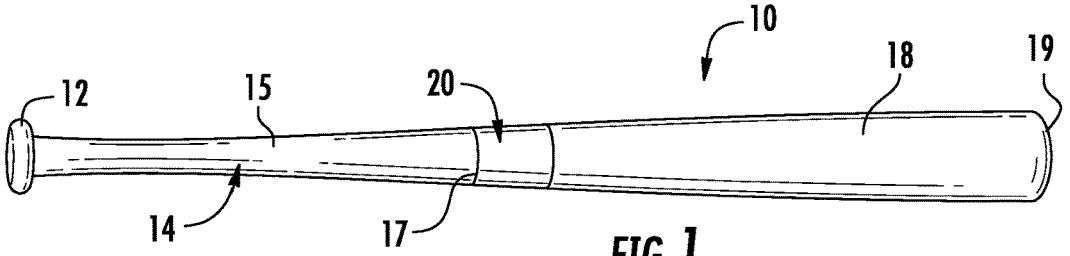
FIG. 1 is a perspective view of a baseball bat with pine tar applicator coupled thereto, according to the present invention.

Turning now to the drawings in which like reference characters indicate corresponding elements throughout the several views, attention is first directed to FIG. 1 which illustrate a baseball bat generally designated 10. Baseball bat 10 is a conventional bat 10 including a knob 12 at one end from which extends a handle 14 having a grip portion 15 and a throat portion 17, a barrel 18 extending from handle 14 and terminating in an end 19. A pine tar applicator generally designated 20 is coupled to and carried by bat 10 intermediate grip portion 15 and barrel 18 generally at throat portion 17. While pine tar is used primarily on wooden bats, it will be understood that other bats are included, including aluminum bats, composite bats and the like.

Figure 2:
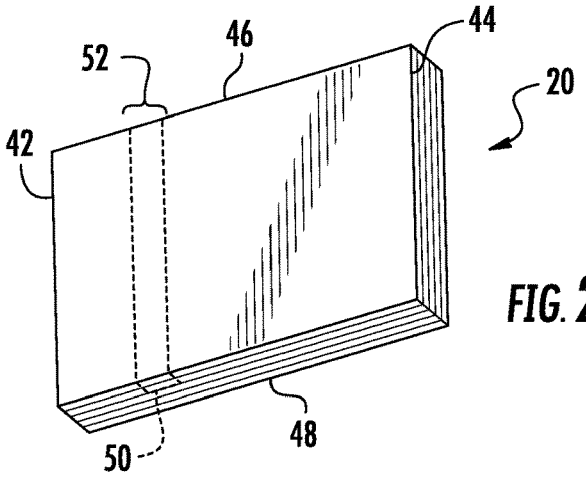
FIG. 2 is a perspective view of a pine tar applicator according to the present invention.
Figure 3:
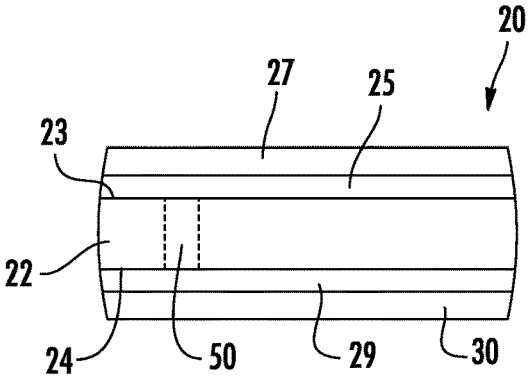
FIG. 3 is a sectional end view of the pine tar applicator of FIG. 2.
Figure 4:
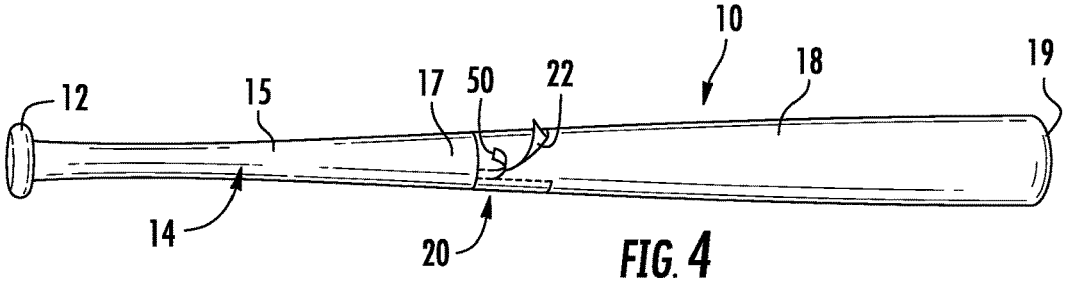
FIG. 4 is a view of the bat of FIG. 1 with the pine tar applicator partially removed.

With additional reference to FIGS. 2 and 3, pine tar applicator 20 includes a base sheet 22 which is a flexible sheet material such as paper, plastic, woven fabric and the like, having opposing sides 23 and 24. Side 23 carries a pine tar layer 25 coating at least a portion thereof. A cover sheet 27 covers layer 25 prior to application. It will be understood, that pine tar includes the traditional pine tar material conventionally used in baseball as well as faux pine tar, pine tar substitutes and other sticky materials applied to a baseball bat grip to enhance a player's grip. Opposing side 24 of base sheet 22 carries an adhesive layer 29. Adhesive layer 29 preferably includes a contact adhesive which will only partially cure. This is a releasable adhesive that will release upon an applied pressure. In other words, adhesive layer 29 employs an adhesive which does not fully cure, remaining "tacky" when applied to handle 14 of bat 10. The adhesive strength and the release point of the adhesive being important to allow removal of base sheet 22 when desired while preventing slipping of base sheet 22 when a batter grasps it. The adhesive strength is sufficient to securely affix base sheet 22 to bat 10 under normal use, while having a release point allowing separation of base sheet 22 from bat 10 under greater loads resulting from peeling sheet 22 from bat 10. "Normal use" means the batter momentarily gripping applicator 20 to obtain pine tar. Adhesive layer 29 is covered by a protective sheet 30 before application to bat 10. Adhesive layer 29 can entirely cover base sheet 22 or only portions, such as the edges, strips along the length or the like.

In operation, protective sheet 30 is removed from adhesive layer 29. Base sheet 22 includes opposing longitudinal edges 42 and 44 positioned longitudinally along the length of bat 10, and opposing transverse edges 46 and 48 positioned transverse to the longitudinal axis of bat 10. Base sheet 22 is wrapped around bat 10, preferably at throat 17, with adhesive layer 29 contacting the surface of bat 10. At this point, cover sheet 27 is removed from pine tar layer 25, exposing it for use. Base sheet 22 can have various dimensions, but should have a length of at least a hand along longitudinal edges 42 and 44. The length of edges 46 and 48 should be sufficient to encircle handle 14 of bat 10. While edges 42 and 44 can be made shorter, the width of a hand makes it more functional. Thus, edges 42 and 44 are preferably 2-6 inches, while the length of edges 46 and 48 are preferably 4-6 inches.

Applicator 20 can be removed simply by peeling it from bat 10, but in a preferred embodiment, included in base sheet 22 is a perforated strip 50 extending between edge 46 and edge 48, and having a tab 52. Adhesive layer 29 can be omitted from this strip to facilitate removal if desired. When this strip is removed along the perforation, applicator 20 can be easily peeled from bat 10.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A combination of a pine tar applicator and a baseball bat comprising:

a baseball bat including a knob at one end from which extends a handle having a grip portion and a throat portion, a barrel extends from the handle and terminates in an end; and a pine tar applicator comprising:

a base sheet having a first side and a second side;

a pine tar layer coating at least a portion of the first side of the base sheet, the pine tar at least partially transferable from the first side of the base sheet to the grip portion;

an adhesive layer overlying at least a portion of the second side of the base sheet; and the base sheet wrapped around the handle of the baseball bat only at the throat portion with the adhesive contacting the bat.

2. A combination as claimed in claim 1 wherein the adhesive layer includes a contact adhesive.

3. A combination as claimed in claim 1 wherein the base sheet includes opposing longitudinal edges positioned longitudinally along a length of the bat, and opposing transverse edges positioned transverse to a longitudinal axis of the bat.

4. A combination as claimed in claim 3 wherein a perforated strip is formed in the base sheet and extends between the opposing transverse edges.

5. A combination as claimed in claim 4 wherein the adhesive layer is omitted from the perforated strip.

6. A method of using a pine tar applicator with a baseball bat comprising the steps of:

providing a baseball bat including a knob at one end from which extends a handle having a grip portion and a throat portion, a barrel extends from the handle and terminates in an end;

providing a pine tar applicator including a base sheet having a first side and a second side, a pine tar layer coating at least a portion of the first side of the base sheet, a cover sheet overlying and covering the pine tar layer, an adhesive layer overlying at least a portion of the second side of the base sheet, and a protective sheet overlying and covering the adhesive layer;

removing the protective sheet from the adhesive layer;

wrapping the base sheet around the handle of the baseball bat only at the throat portion with the adhesive contacting the bat;

removing the cover sheet to expose the pine tar layer; and transferring at least a portion of the pine tar from the first side of the base sheet to the grip portion.

7. A method of using a pine tar applicator with a baseball bat as claimed in claim 6 wherein the step of providing an adhesive layer includes providing a contact adhesive.

8. A method of using a pine tar applicator with a baseball bat as claimed in claim 7 further comprising the step of peeling the base sheet from the baseball bat.

9. A method of using a pine tar applicator with a baseball bat as claimed in claim 7 wherein the step of providing the base sheet includes providing the base sheet having opposing longitudinal edges positioned longitudinally along a length of the bat, and opposing transverse edges positioned transverse to a longitudinal axis of the bat.

10. A method of using a pine tar applicator with a baseball bat as claimed in claim 9 wherein the step of providing a pine tar applicator including a base sheet includes providing a perforated strip formed in the base sheet and extending between the opposing transverse edges.

11. A method of using a pine tar applicator with a baseball bat as claimed in claim 10 further includes the steps of:

removing the perforated strip from the base sheet; and peeling the base sheet from the baseball bat.

12. A method of using a pine tar applicator with a baseball bat as claimed in claim 11 wherein the step of providing a perforated strip includes omitting the adhesive layer from the perforated strip.

* * * * *